US010494910B2

(12) United States Patent
Wood et al.

(10) Patent No.: US 10,494,910 B2
(45) Date of Patent: Dec. 3, 2019

(54) ACTIVE EXTERNAL CASING PACKER (ECP) FOR FRAC OPERATIONS IN OIL AND GAS WELLS

(71) Applicant: Meta Downhole Limited, Aberdeen (GB)

(72) Inventors: Peter Wood, Aberdeen (GB); Fraser Louden, Kintore (GB); Stuart Berry, Aberdeen (GB); Andrew John Gorrara, Stonehaven (GB); Duncan James Trinder, Inverurie (GB)

(73) Assignee: MORPHPACKERS LIMITED, Aberdeen (GB)

( * ) Notice: Subject to any disclaimer, the term of this patent is extended or adjusted under 35 U.S.C. 154(b) by 351 days.

(21) Appl. No.: 14/974,539

(22) Filed: Dec. 18, 2015

(65) Prior Publication Data

US 2016/0168971 A1 Jun. 16, 2016

Related U.S. Application Data

(62) Division of application No. 13/322,763, filed as application No. PCT/GB2010/050885 on May 27, 2010, now Pat. No. 9,217,308.

(30) Foreign Application Priority Data

May 27, 2009 (GB) ..... 0909086.1

(51) Int. Cl.
*E21B 43/267* (2006.01)
*E21B 33/12* (2006.01)
(Continued)

(52) U.S. Cl.
CPC ..... *E21B 43/267* (2013.01); *E21B 17/042* (2013.01); *E21B 33/126* (2013.01);
(Continued)

(58) Field of Classification Search
CPC ..... E21B 33/1204; E21B 33/1208; E21B 33/1212; E21B 33/1216; E21B 33/122;
(Continued)

(56) References Cited

U.S. PATENT DOCUMENTS 4,258,788 A * 3/1981 Patton ..... E21B 17/046 166/185
4,353,249 A 10/1982 Lagus et al.
(Continued)

FOREIGN PATENT DOCUMENTS

EP 0522628 A2 1/1993
EP 1455052 A2 9/2004
(Continued)

OTHER PUBLICATIONS

Ott, Stephane, "International Search Report" for PCT/GB2010/050885, as dated May 11, 2011, 4 pages.
(Continued)

*Primary Examiner* — David Carroll
(74) *Attorney, Agent, or Firm* — Law Office of Jesse D. Lambert, LLC

(57) ABSTRACT

A zonal isolation device in the form of an active external casing packer is provided which includes a tubular section such as a casing or liner and at least one sleeve member positioned on the exterior of the casing or liner and sealed thereto. The method detailed herein provides zonal isolation by use of a pair of spaced apart sleeve members during a frac operation where frac fluid is supplied to a zone (in between the pair of sleeve members) requiring to be frac'd, where the frac pressure acts not only on the outside of the zonal isolation device but also on the interior of the sleeve member to enhance the seal provided thereby.

15 Claims, 15 Drawing Sheets

(51) Int. Cl.

| | |
|---|---|
| ***E21B 33/124*** | (2006.01) |
| ***E21B 43/26*** | (2006.01) |
| ***E21B 17/042*** | (2006.01) |
| ***E21B 33/126*** | (2006.01) |
| ***E21B 34/06*** | (2006.01) |
| ***E21B 43/11*** | (2006.01) |
| ***E21B 43/14*** | (2006.01) |
| *E21B 34/00* | (2006.01) |

(52) U.S. Cl.
CPC ..... *E21B 33/1212* (2013.01); *E21B 33/1246* (2013.01); *E21B 34/06* (2013.01); *E21B 43/11* (2013.01); *E21B 43/14* (2013.01); *E21B 43/26* (2013.01); *E21B 2034/007* (2013.01)

(58) Field of Classification Search
CPC ..... E21B 33/124; E21B 33/1243; E21B 33/1246; E21B 43/26
USPC ..... 166/308, 187, 195, 387, 118, 122, 196, 166/212
See application file for complete search history.

(56) References Cited

U.S. PATENT DOCUMENTS

| | | | | |
|---|---|---|---|---|
| 4,421,165 | A | 12/1983 | Szarka | |
| 5,295,393 | A | 3/1994 | Thiercelin | |
| 5,363,542 | A | 11/1994 | Sorem et al. | |
| 5,400,855 | A | 3/1995 | Stepp et al. | |
| 6,640,893 | B1 | 11/2003 | Rummel et al. | |
| 7,017,670 | B2 | 3/2006 | Hazel et al. | |
| 7,306,033 | B2 | 12/2007 | Gorrara | |
| 2003/0019628 | A1 | 1/2003 | Ravensbergen | |
| 2003/0127227 | A1* | 7/2003 | Fehr | E21B 33/124 166/306 |
| 2004/0000406 | A1 | 1/2004 | Allamon et al. | |
| 2004/0055758 | A1 | 3/2004 | Brezinski | |
| 2005/0061508 | A1* | 3/2005 | Surjaatmadja | E21B 33/1243 166/306 |
| 2006/0027371 | A1* | 2/2006 | Gorrara | E21B 33/12 166/313 |
| 2006/0042801 | A1 | 3/2006 | Hackworth | |
| 2006/0124310 | A1 | 6/2006 | Lopez de Cardenas et al. | |
| 2007/0151734 | A1* | 7/2007 | Fehr | E21B 33/124 166/305.1 |
| 2008/0035350 | A1 | 2/2008 | Henriksen et al. | |
| 2008/0277110 | A1* | 11/2008 | Themig | E21B 33/124 166/191 |
| 2010/0044041 | A1* | 2/2010 | Smith | E21B 34/14 166/280.1 |
| 2010/0084133 | A1 | 4/2010 | Weirich et al. | |
| 2011/0073308 | A1 | 3/2011 | Assal et al. | |

FOREIGN PATENT DOCUMENTS

| | | | |
|---|---|---|---|
| EP | 1914380 | A1 | 4/2008 |
| EP | 2206879 | A1 | 7/2010 |
| GB | 2079819 | A | 1/1982 |
| GB | 2398312 | A | 8/2004 |
| WO | WO 2004/046500 | A1 | 6/2004 |
| WO | WO 2007/031723 | A2 | 3/2007 |

OTHER PUBLICATIONS

Snyder, D., "Production Results From a New Horizontal Completion Method in the Barnett Shale," AADE 2009 NTCE-02-03, 2009, 4 pages, AADE, New Orleans, LA US.
Vinje, L. and Hundsnes, S., "External Casing Packer—Zonal Isolation System," Well Informed, Dec. 4, 2010, p. 12, Statoil, Norway.
TAM International, "TAM Intervention Scab Liner Systems," date unknown, 4 pages, Houston, TX US.
Dreesen, D.S., "Analytical and Experimental Evaluation of Expanded Metal Packers for Well Completion Service," SPE 22858, Oct. 1991, 9 pages, Dallas, TX US.

* cited by examiner

ACTIVE EXTERNAL CASING PACKER (ECP) FOR FRAC OPERATIONS IN OIL AND GAS WELLS

The present invention relates to apparatus and methods for isolating an annulus in a downhole wellbore by securing a tubular within the wellbore. In particular the invention has application for centralising and/or securing a casing tubular or liner tubular within an open borehole in an oil, gas or water wellbore and for isolating a portion of the borehole located below the apparatus from a portion of the borehole located above the apparatus. Furthermore the invention is well suited to well frac operations that require isolation of the reservoirs; the pressure used in the frac operation increases the ability of the invention to isolate zones from unwanted fluid movement and pressure.

Oil, gas or water wells are conventionally drilled with a drill string; which comprises drill pipe, drill collars and drill bit(s). The drilled open hole is hereinafter referred to as a "borehole". The drillstring is pulled out of hole (POOH) and at least the upper section of the borehole is typically provided with casing sections, liners and/or production tubing in a stage referred to as "completing" the borehole. The casing is usually cemented in place to prevent at least the upper section of the borehole from collapse and also provides a pressure barrier in the annulus between the outer surface of the casing and inner surface of the bore hole and also fixes the casing to the borehole to prevent axial movement when the casing is under load. The casing is usually in the form of at least one large diameter pipe.

It is sometimes beneficial to perform a reservoir fracture operation (commonly referred to as a "frac"). During a frac, certain fluids are pumped at relatively high pressure and volume into particular zones of the reservoir in order to create or open up a fracture in the rock that will assist the flow of oil or gas into the well. To be most effective, the fluid type, pressure and volume pumped will be tuned to one particular zone, hence it is often necessary to isolate the targeted zone from all the other zones at this stage of the operation.

Other types of well operations exist such as "stimulation" whereby fluid such as steam, CO2 or another gas or liquid is "injected" into the well or reservoir at pressure. The effect of this injection pressure in relation to the present invention is substantially the same as in a frac operation. In this document it is a frac operation that is referred to but could equally be any injection operation.

According to a first aspect of the present invention there is provided apparatus comprising:—

- a tubular section arranged to be run into and secured within an open borehole;
- at least one sleeve member wherein the sleeve member is positioned on the exterior of the tubular section and sealed thereto;
- wherein at least one deformable band member is provided around and is preferably bonded to the outer circumference of the sleeve member; and
- pressure control means operable to alter the pressure within the sleeve member such that an increase in pressure causes the sleeve to move outwardly and bear against an inner surface of the open borehole.

Preferably, the pressure control means may be provided by pressuring the entire length of the tubular section or any part of it that contains the sleeve member. Pressure can be provided from surface or may be generated down hole.

Additionally, the sleeve member may be located on the exterior of a custom made mandrel or sleeve carrier. In such an embodiment, such a mandrel or sleeve carrier is connected to the tubular section by way of threads or other suitable connection means at each end of the mandrel or sleeve carrier.

The large diameter structure may be an open hole borehole, where the open borehole may be located below a borehole section lined with a casing or liner string which may be cemented in place downhole.

The tubular section is preferably located coaxially within the sleeve. Therefore the present invention allows a casing section or liner to be centralised within a borehole by provision of an expandable sleeve member positioned around the tubular section.

The tubular section can be used within a wellbore, run into an open or cased oil, gas or water well. The tubular section may be a part of a liner or casing string. In this context, the term "liner" refers to sections of casing string that do not extend to the top of the wellbore, but are anchored or suspended from the base region of a previous casing string. Sections of liner are typically used to extend further into a wellbore, reduce cost and allow flexibility in the design of the wellbore.

As previously stated casing sections are often cemented in place following their insertion into the borehole. Extension of the wellbore can be achieved by attaching a liner to the interior of a base portion of a casing section. Ideally the liner should be secured in position and this is conventionally achieved by cementing operations. However, cementing sections of liner in place is time consuming and expensive and in horizontal or highly deviated wells is often not successful or effective. The present invention can be used as a means to centralise and secure such a liner section within an open borehole, thus removing the need for cementing.

Downhole embodiments of the apparatus can be used to isolate one section of the downhole annulus from another section of the downhole annulus and thus can also be used to isolate one or more sections of downhole annulus from the production conduit. The apparatus preferably comprises a means of securing the sleeve member against the exterior of the tubular member which may be a casing section or liner wall and preferably, the sleeve member provides a means of creating a reliable hydraulic seal to isolate the annulus, typically by means of an expandable metal element.

The sleeve member can be coupled to the casing section, liner or mandrel by means of welding, clamping, threading or other suitable means.

Preferably the apparatus is also provided with seal means. The function of the seal means is to provide a pressure tight seal between the exterior of the tubular section and the sleeve member, which may be the interior or one or both ends of the sleeve member.

The seal means can be mounted on the tubular section to seal the sleeve member against the exterior of the tubular section. A chamber is created, which chamber is defined by the outer surface of the tubular section, the inner surface of the sleeve member and an inner face of the seal means. The seal means may be annular seals which may be formed of an elastomer or any other suitable material.

Preferably, the sleeve member is secured to an end member at each end thereof, wherein the end member is preferably provided with the seals means to seal against the exterior of the tubular section. More preferably, the sleeve member is secured to the end members by welding and more preferably, an annular shroud member is provided around the welding in a close fit thereto to retard expansion thereof.

The sleeve may be manufactured from metal which undergoes elastic and plastic deformation. The sleeve member is preferably formed from a softer and/or more ductile material than that used for the casing section or liner.

Suitable metals for manufacture of the sleeve member include certain types of steel. Further, the sleeve member may be provided with a deformable coating such as an elastomeric coating which may be configured as a single coating or multiple discreet bands. In this latter preferred embodiment, the elastomer bands are spaced such that when the sleeve is expanded the bands will contact the inside surface of the open borehole first. The sleeve member will continue to expand outwards into the spaces between the bands, thereby causing a corrugated effect on the sleeve member. These corrugations provide a great advantage in that they increase the stiffness of the sleeve member and increase its resistance to collapse forces.

Preferably, the at least two deformable band members comprise annular rings comprising a width W and a height H, wherein they are spaced apart along the length of sleeve member by a distance S. The width W may be a greater distance than the distance S although this need not be the case. Preferably, the sleeve member comprises a substantially constant outer diameter such that the at least two deformable bands project radially outwardly from the sleeve member by their height H such that when the sleeve member is expanded, the at least two deformable bands contact the inside surface of the outer larger diameter structure first.

In addition the sleeve member may be provided with a non-uniform outer surface such as ribbed, grooved or other keyed surface in order to increase the effectiveness of the seal created by the sleeve member when secured within another casing section or borehole.

According to another aspect of the present invention, the pressure control means comprise a hydraulic tool equipped with at least one aperture. Additionally, the tubular section preferably comprises at least one port to permit the flow of fluid into and out of the chamber created by the sleeve member. In operation the hydraulic tool is capable of delivering fluid through the aperture of the hydraulic tool under pressure and through the at least one port in the tubular member into the chamber. The hydraulic tool may contain hydraulic or electrical systems to control the flow and/or pressure of said fluid.

The pressure control means may also be operable to monitor and control the pressure within the casing section. The pressure in the sleeve member is preferably increased between seal means and may be achieved by introduction of pressurised fluid.

Pressure within the sleeve member is preferably increased so that the sleeve member expands and contacts the outer casing or borehole wall, until sufficient contact pressure is achieved resulting in a pressure seal between the exterior of the sleeve member and the inner surface of the casing or borehole wall against which the sleeve member can bear. Ideally, this pressure seal should be sufficient to prevent or reduce flow of fluids from one side of the sleeve member to the other and/or provide a considerable centralisation force.

The pressure seal achieved by the contact of the sleeve member with the casing or borehole can be improved if the inside surface of the sleeve member remains at a pressure similar to that which the device is trying to seal against; the internal pressure increases the squeeze on the elastomer material on the outside of the sleeve and also reduces or prevents any external pressure on the sleeve from collapsing the sleeve, which could result in a loss of seal. The relatively high internal pressure can be achieved during a frac operation or by the use of check valves to lock in the expansion pressure.

The initial outside diameter of the sleeve member and elastomer coating can increase on expansion of the sleeve member to seal against the interior of the wellbore or other casing section.

The sleeve can be expanded by various means. According to one aspect of the invention, the tubular section is provided with at least one port formed through its sidewall and positioned between the seals of the sleeve member to allow fluid under pressure to travel there through from a throughbore of the tubular section into the chamber.

The port(s) may be provided with check valves, isolation valves or another form of one way valve which, on hydraulic expansion of the sleeve into its desired position, act to prevent flow of fluid from the chamber to the throughbore of the tubular section to preferably maintain the sleeve in its expanded configuration once the hydraulic tool is withdrawn. In this context, check valve or isolation valve is intended to refer to any valve which permits flow in only one direction. The check valve design can be tailored to specific fluid types and operating conditions.

In other words, the port in the tubular section may have a one way valve installed therein such that pressure applied through the port to the sleeve member is contained within the chamber once the applied pressure has been reduced.

A second valve, preferably in the form of a pressure relief valve, may be placed in one or more ports and is preferably configured to allow some pressure (say anything above a certain psi for example) to escape back into the liner bore once the hydraulic expansion pressure has been removed. This allows the pressure that remains trapped within the chamber to be selected to best meet the needs of the application. In other words, a further port may be provided in the tubular section and has a one way valve that would permit some fluid movement in the other direction i.e. from the chamber back into the inner throughbore; in such an embodiment, such a valve would be set at a lower pressure than the applied pressure so that the pressure retained within the chamber is at a lower pressure than the applied pressure.

Alternatively, or additionally, a ruptureable barrier device, such as a burst disk device or the like, may be formed in the sidewall of the sleeve member, where the burst disk device prevents fluid flow through itself until an operator intentionally ruptures the burst disk by, for example, applying hydraulic fluid pressure to the tubing side of the burst disk (and therefore the chamber) until the pressure is greater than the rated strength of the burst disk.

Alternatively, the port(s) may be provided with a ruptureable barrier device, such as a burst disk device or the like, which prevents fluid flow from the throughbore of the casing/liner string through the port(s) until an operator intentionally ruptures the barrier device by, for example, applying hydraulic fluid pressure to the throughbore of the tubing side of the barrier device until the pressure is greater than the rated strength of the barrier device.

The use of such an optional barrier device can be advantageous if an operator wishes to keep well fluids out of the sleeve chamber until the sleeve is ready for expansion.

Another method of effecting expansion of the sleeve member involves insertion of a chemical fluid which can set to hold the sleeve member in place. An example of such fluid is cement.

Towards the end of each sleeve member, sliding seals between the interior of the sleeve member and exterior of the tubular casing may be provided. A sliding seal allows movement in a longitudinal direction to shorten the distance between the ends of the sleeve member such that outward movement of the sleeve does not cause excessive thinning of the sleeve member.

Alternatively the ends of the sleeve member may be fixed to the liner at both ends.

Expansion of the sleeve can be facilitated by provision of a sliding seal and/or through elastic and/or plastic deformation when the sleeve member yields. The sleeve member should preferably expand such that contact is effected between the exterior of the sleeve member and another pipe or borehole wall. In this way the at least one outer sleeve can be used to support or centralise the tubular member within an outer tubular member or borehole. The apparatus can also be used to isolate one part of annular space from another section of annular space. The outer sleeve members can be utilised to centralise one casing section within another or within an open hole well section.

There can be a plurality of sleeve members on a casing section to isolate separate zones and separate formations from one another. The plurality of sleeve members may be expanded individually, in groups or simultaneously. In a situation when it is desired that all sleeve members are expanded simultaneously, this can be achieved by increasing the pressure within the entire casing section. Expansion of individual sleeve members or groups of sleeve members can be achieved by plugging or sealing internally above and below the ports which communicate with the respective sleeve members to be expanded and the pressure between these seals can be increased to the desired level. The upper plug may be at surface such that the whole well is pressurised.

An alternative pressure control means and another method of expanding the sleeve member(s) is to connect each of the apparatus with a hydraulic line such as a control line. In such an embodiment the hydraulic line is run on the outside surface of the tubular section (typically a liner or casing) and would connect into the internal chamber of each sleeve member. A port through the wall of the tubular section would not typically be required at each sleeve member; instead, the hydraulic line would typically be terminated at a position on the liner higher up in the well bore. A single hydraulic port in the liner would preferably allow communication to the hydraulic line. Typically, pressure applied to the inside of the liner in the area of this port, either by a setting tool or by pressuring the well, would allow the sleeves to be expanded. Alternatively, the control line may extend all the way to surface.

According to a further aspect of the present invention there is provided apparatus comprising:—

- a tubular section arranged to be run into and secured within an open borehole;
- at least one sleeve member wherein the sleeve member is positioned on the exterior of the tubular section and sealed thereto; and
- pressure control means operable to alter the pressure within the sleeve member such that an increase in pressure causes the sleeve to move outwardly and bear against an inner surface of the larger diameter structure;
- wherein the pressure control means is coupled to a chamber created between an outer surface of the tubular section and an inner surface of the sleeve member by a hydraulic conduit which extends at least partly co-axially with the longitudinal axis of the tubular section.

Typically, the hydraulic conduit comprises a hydraulic line. Preferably, the hydraulic line is run on the outside surface of the tubular section (typically a liner or casing) and would connect into the internal chamber of each sleeve member. A port through the wall of the tubular section would not typically be required at each sleeve member; instead, the hydraulic line would typically be terminated at a position on the liner higher up in the well bore. A single hydraulic port in the liner would preferably allow communication to the hydraulic line. Typically, pressure applied to the inside of the liner in the area of this port, either by a setting tool or by pressuring the well, would allow the sleeves to be expanded. Alternatively, the control line may extend all the way to surface.

In certain circumstances it is necessary to isolate portions of annular space from adjacent portions within a wellbore. The present invention also creates a reliable seal to isolate the annulus. Typically, the open borehole is a generally cylindrical structure having a larger diameter than the tubular section to be run into the open borehole and an inner surface defining a throughbore.

The apparatus has a dual function since it can be utilised with concentric tubulars such as pipelines to support or centralise the inner member inside an outer member and to isolate one part of annular space from another.

According to another aspect of the present invention, a casing section is provided with perforations. In this situation sleeve members may be located either side of a perforation in the casing section allowing fluid from the well to enter the casing through the perforation, with the expandable sleeve members acting as an impediment to prevent fluid from entering different annular zones.

According to another aspect of the present invention there is provided a method of performing zonal isolation during a FRAC operation with a liner that has been pre-perforated, the method comprising the steps of:— a) drilling the borehole, b) run in completion which may be in the form of a casing/liner string and which is installed in the open hole borehole, wherein at least one zonal isolation device is provided on or associated with the casing/liner string, the zonal isolation device comprising a sleeve member defining a chamber into which pressurised fluid can be inserted from the throughbore of the casing/liner string to expand the sleeve member outwards towards the open hole borehole;

c) run a tool into the throughbore of the casing/liner string into the vicinity of the pre-perforated liner and operate the tool to introduce fluid under pressure into the throughbore of the casing/liner string section to expand and thereby activate the zonal isolation device(s) such that the at least one zonal isolation device provides a seal against the open hole;

d) supply frac fluid into the throughbore of the casing/liner string and thereafter to the zone requiring to be frac'd in order to perform the frac; and e) repeat steps c) and d) as required for each additional zone to be frac'd, whereby the frac pressure acts not only on the outside of the zonal isolation device but also on the interior of the zonal isolation device to enhance the seal provided thereby.

According to another aspect of the present invention there is provided a method of performing zonal isolation during a FRAC operation with a liner that has not been pre-perforated, the method comprising the steps of:— a) drilling the borehole, b) run in completion which may be in the form of a casing/liner string and which is installed in the open hole borehole, wherein at least one zonal isolation device is provided on or associated with the casing/ liner string, the zonal isolation device comprising a sleeve member defining a chamber into which pressurised fluid can be inserted to expand the sleeve member outwards towards the open hole borehole;

c) pressure up the throughbore of the casing/liner string section from the surface to activate and thereby expand the zonal isolation device(s) toward and into contact with the inner surface of the open borehole;

d) open at least one communication channel from the liner to the frac zone (this step may be performed by perforating the casing/liner string or by opening a sliding sleeve to expose ports in the liner for example);

e) running a tool into the throughbore of the casing/liner string to supply frac fluid thereto or pumping fluid from the surface into the throughbore of the casing/liner string;

f) permit the supplied frac fluid to flow from the throughbore, through the at least one communication channel and into the zone requiring to be frac'd in order to perform the frac;

g) if present, closing the sliding sleeve; and h) repeat steps d) and g) as required for each additional zone to be frac'd, whereby the frac pressure acts not only on the outside of the zonal isolation device but also on the interior of the zonal isolation device to enhance the seal provided thereby.

During a frac operation high pressure fluid will be pumped into the well and targeted at a particular zone. The present invention will prevent the pumped fluid from travelling along the outside of the liner to other zones. As the frac pressure simultaneously acts on the inside of the liner bore and hence through a port into a chamber within the sleeve member and hence on the inside of the sleeve member thereby increasing the contact with the borehole, the effectiveness of the apparatus and sleeve member in particular to seal against the borehole is enhanced.

The casing section or liner should be designed to withstand a variety of forces, such as collapse, burst, and tensile failure, as well as chemically aggressive brines. Casing sections may be fabricated with male threads at each end, and short-length couplings with female threads may be used to join the individual joints of casing together.

Alternatively the joints of casing may be fabricated with male threads on one end and female threads on the other. The casing section or liner is usually manufactured from plain carbon steel that is heat-treated to varying strengths, but other suitable materials include stainless steel, aluminium, titanium and fibreglass.

In accordance with the present invention there is also provided a method comprising the steps of:

sealing at least one expandable sleeve member on the exterior of a tubular section;

inserting the casing section into a generally cylindrical structure; wherein at least one deformable band member is provided around the outer circumference of the sleeve member; and providing pressure control means operable to increase the pressure within the sleeve member, such that the pressure increase causes the sleeve member to move outwardly allowing the exterior surface of the sleeve member to bear against the inner surface of the generally cylindrical structure.

Preferably, the at least one deformable band member is secured around the outer circumference of the sleeve member and is preferably an elastomer band member. More preferably, there are at least two deformable band members longitudinally spaced apart along the length of the sleeve member, with a gap therebetween, such that upon expansion, the sleeve members expands further into the gap thereby providing a non-uniformity to the structure of the sleeve member.

Preferably, the pressure control means may be provided by pressuring the entire length of the tubular section or any part of it that contains the sleeve member. Pressure can be provided from surface or may be generated down hole.

In certain preferred embodiments the method is useful for centralising one pipe within an open hole well section. More preferably, the apparatus and method are useful in isolating a section of borehole located below the expandable sleeve member from a section of borehole located above the expandable sleeve member. The method and apparatus are particularly suited to and effective when used to isolate zones during a frac operation.

The above-described method comprises inserting the casing section into another section and/or borehole to the required depth. This may be by way of incorporating the casing section into a casing or liner string and running the casing/liner string into the other section or borehole.

With the sleeve member expanded into contact with the inner surface of the larger diameter structure (open bore hole) then pressure within the tubular section may be increased during a well frac or injection operation. This frac or injection pressure will act on the already expanded inside surface of the sleeve member and will act to increase the contact pressure between the outer surface of the sleeve member deformable band member and the inner surface of the larger diameter structure whilst the frac or injection operation is performed. Thus by activating the sleeve member with the same magnitude of pressure as performing the FRAC operation, preferred embodiments of the method should provide a low pressure difference and hence maintain a good pressure seal between the sleeve member/deformable band member and the larger diameter structure during frac or injection operations.

Pressure, volume, depth and diameter of the sleeve member at a given time during expansion thereof can be recorded and monitored by either downhole instrumentation or surface instrumentation.

In the description that follows, the drawings are not necessarily to scale. Certain features of the invention may be shown exaggerated in scale or in somewhat schematic form, and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce the desired results.

The following definitions will be followed in the specification. As used herein, the term "wellbore" refers to a wellbore or borehole being provided or drilled in a manner known to those skilled in the art. Reference to up or down will be made for purposes of description with the terms "above", "up", "upward", "upper", or "upstream" meaning away from the bottom of the wellbore or borehole along the longitudinal axis thereof and "below", "down", "downward", "lower", or "downstream" meaning toward the bottom of the wellbore along the longitudinal axis thereof.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one embodiment can typically be combined alone or together with other features in different embodiments of the invention.

Various embodiments and aspects of the invention will now be described in detail with reference to the accompanying figures. Still other aspects, features, and advantages of the present invention are readily apparent from the entire description thereof, including the figures, which illustrates a number of exemplary embodiments and aspects and implementations. The invention is also capable of other and different embodiments and aspects, and its several details can be modified in various respects, all without departing from the spirit and scope of the present invention.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

Embodiments of the invention will now be described by way of example only and with reference to the accompanying drawings in which:—

Figures 6A, 6B, 6C:
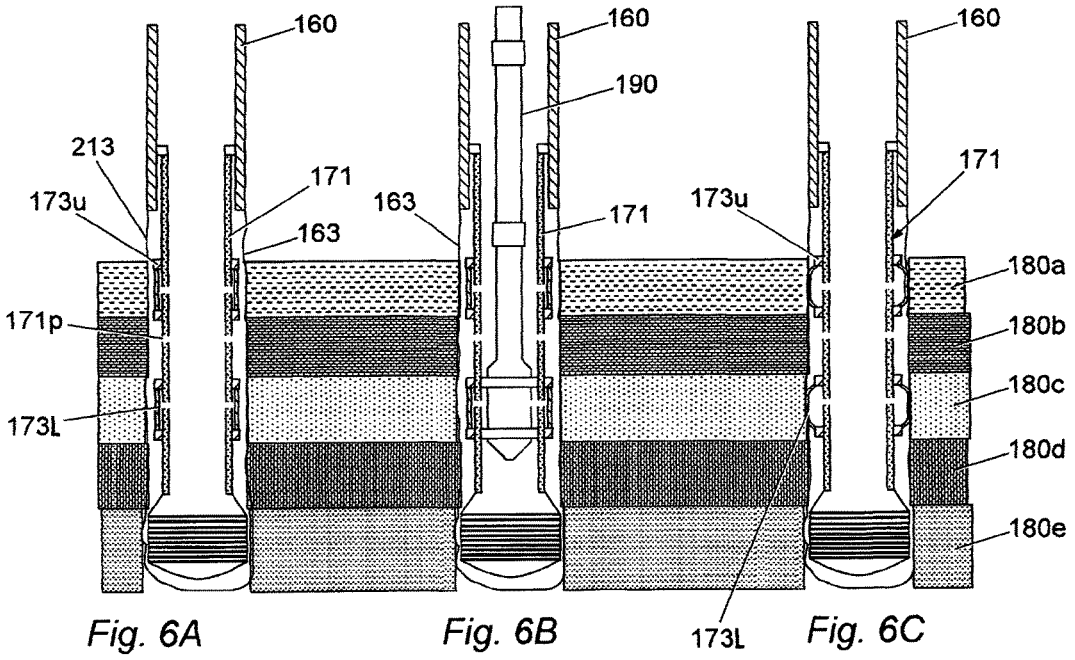
FIG. 6 shows a sequence for expanding two sleeve members.
Figure 7:
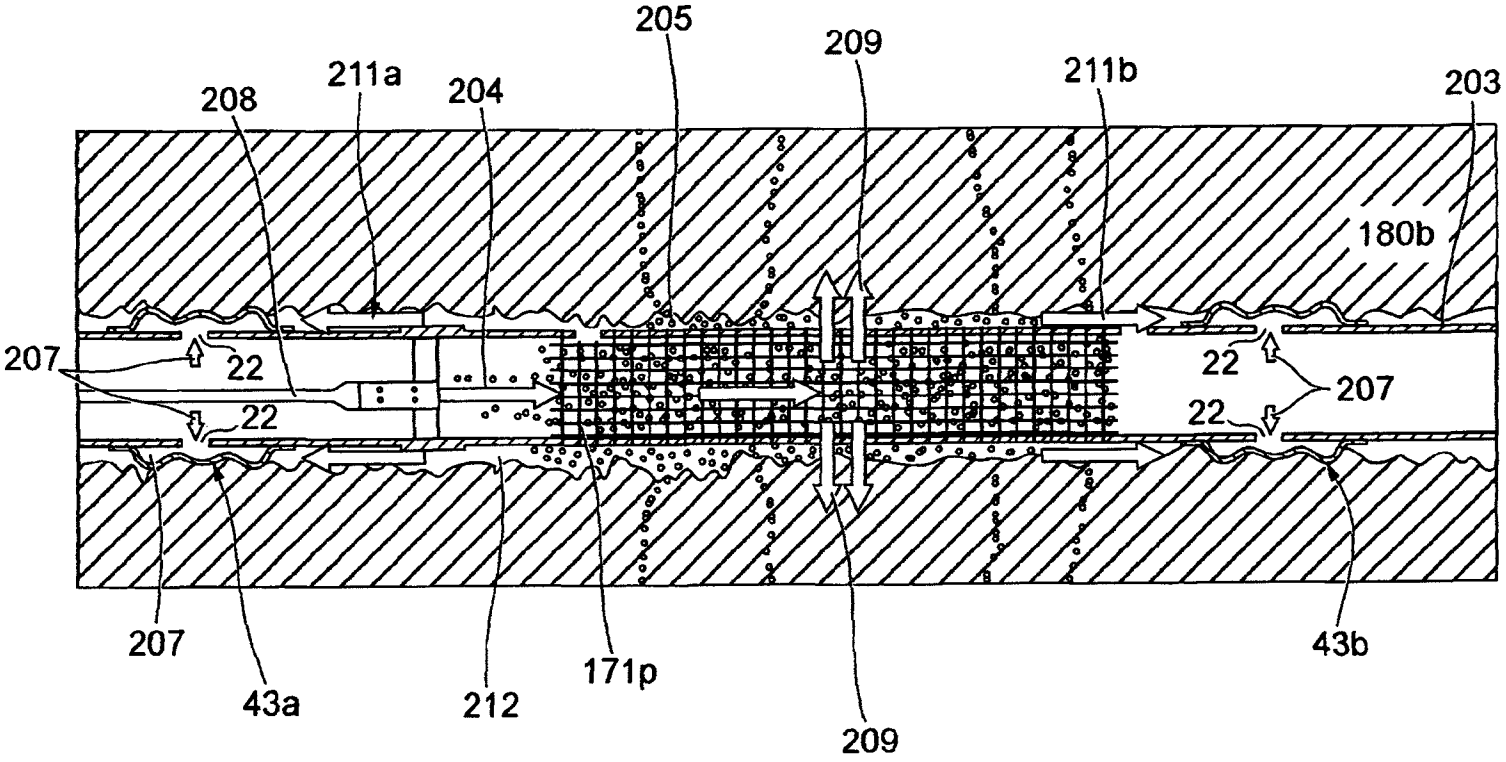
Figure 8:
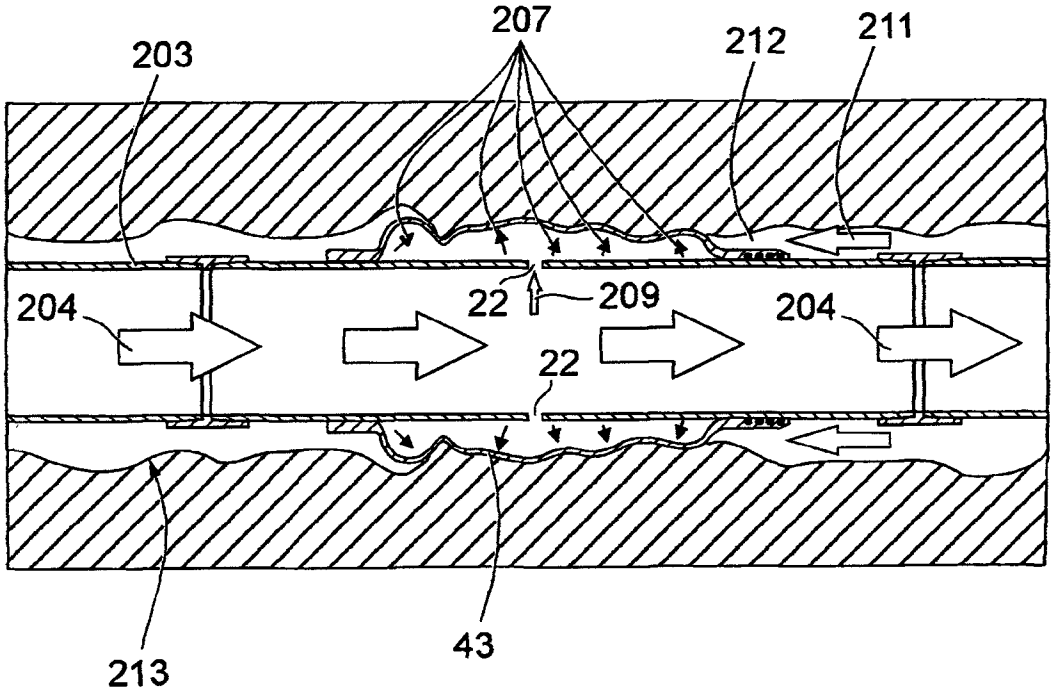
Figure 9:
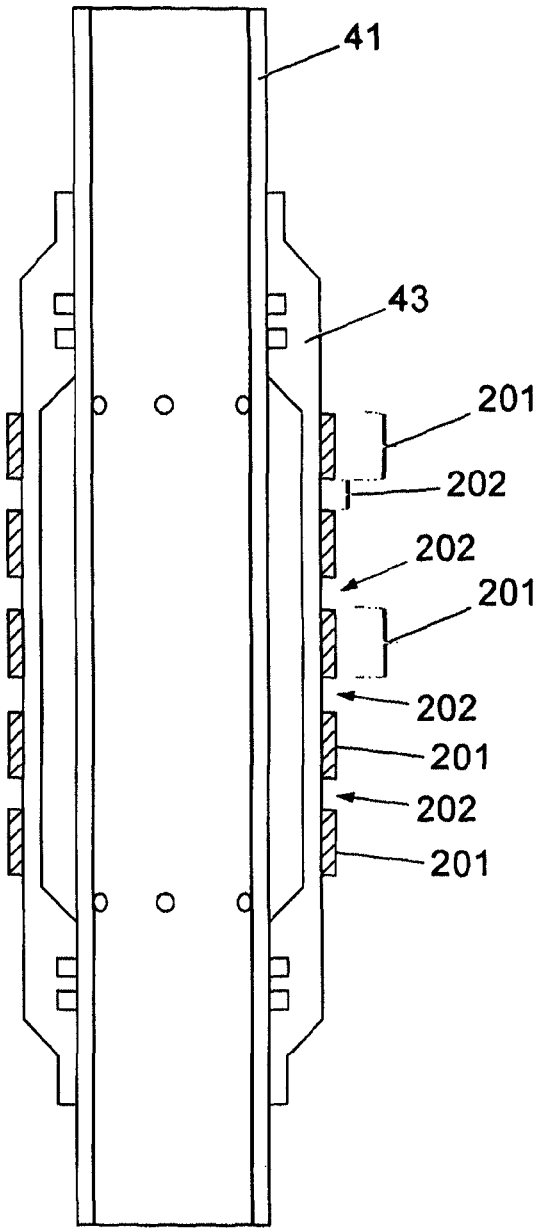
Figure 10:
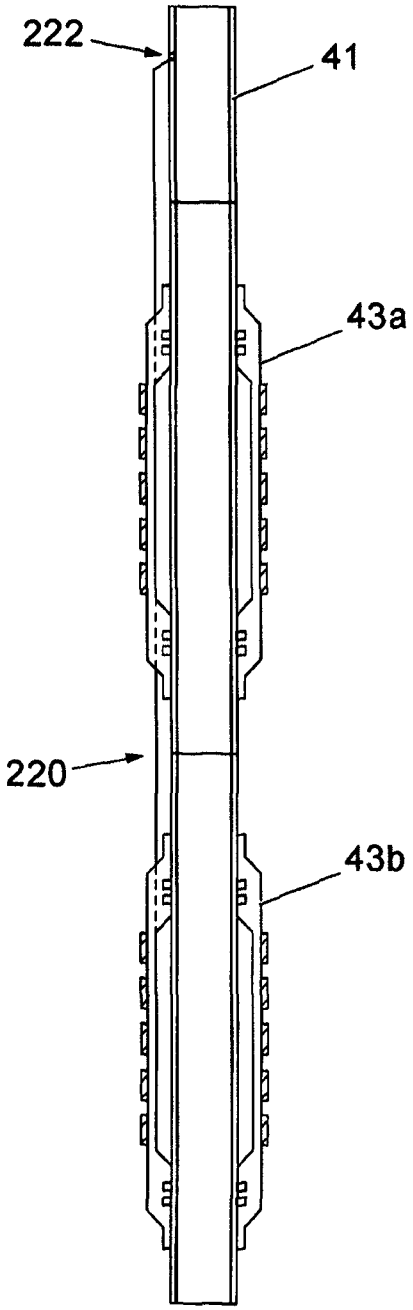
Figure 11A:
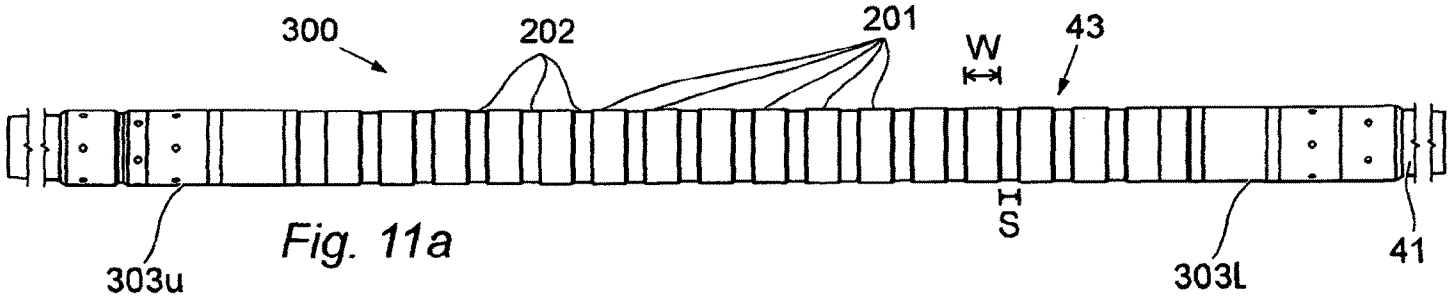
Figure 11B:
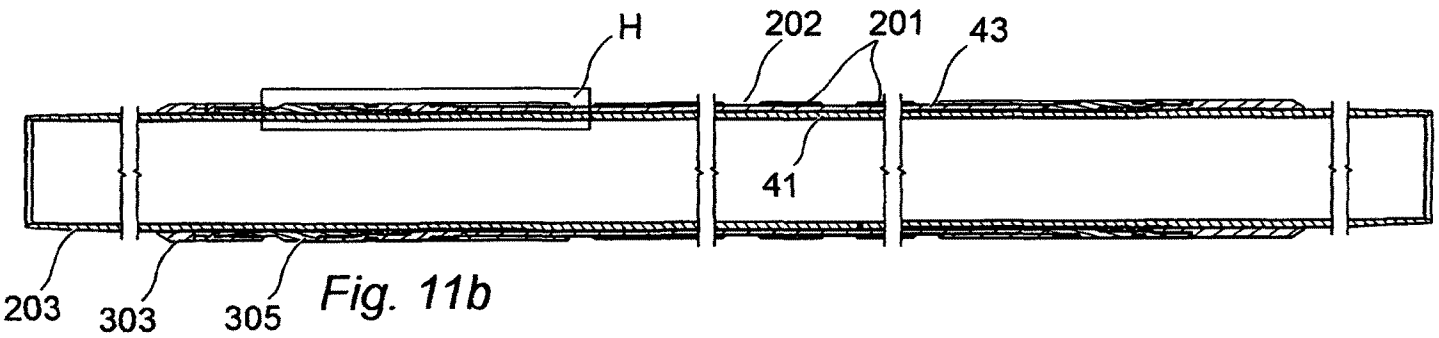
Figure 11C:
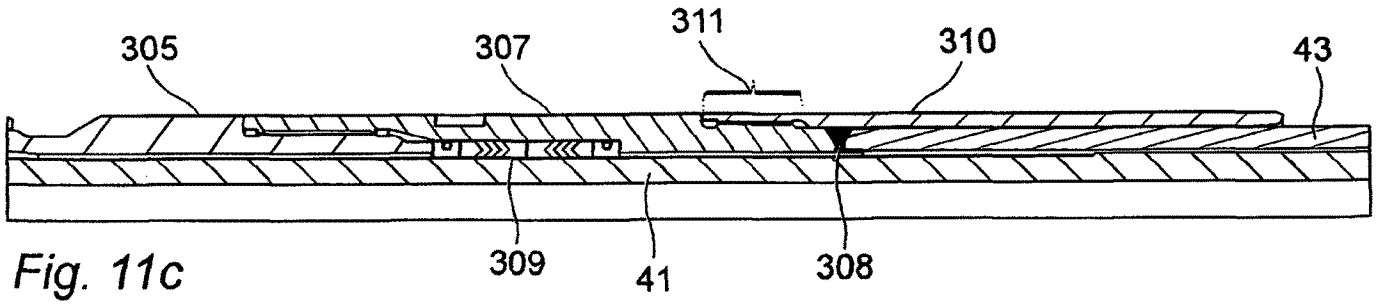
Figure 11D:
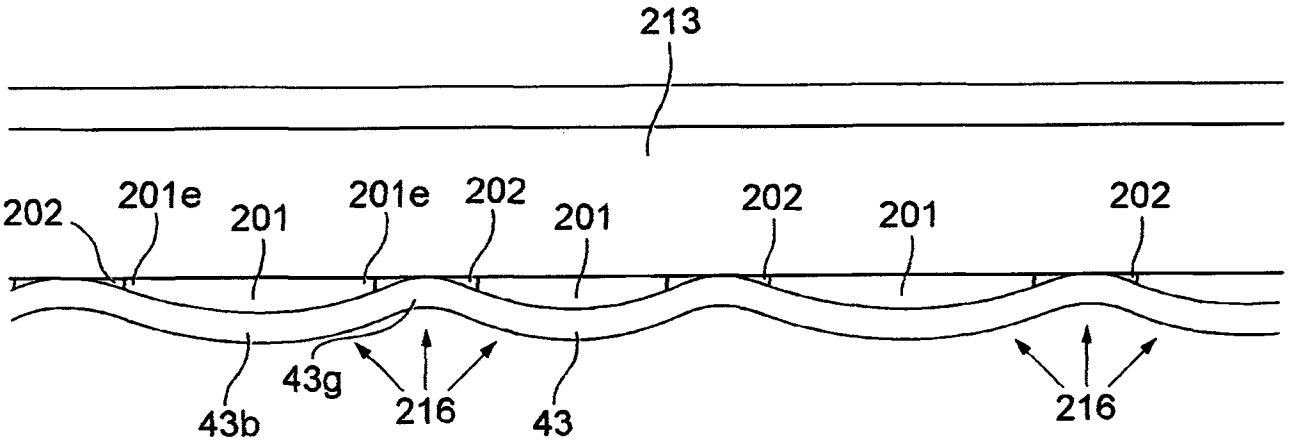
Figure 12:
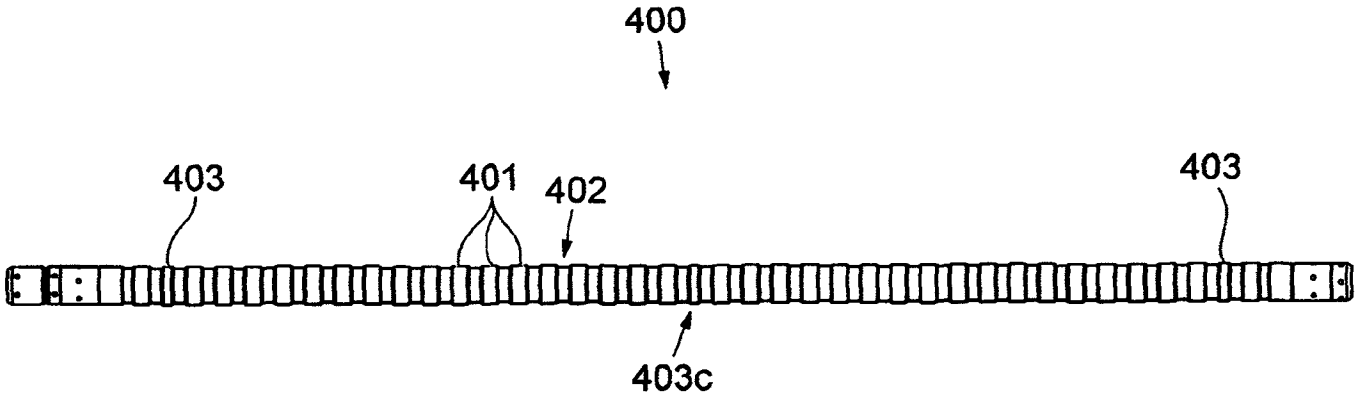
Figure 13:
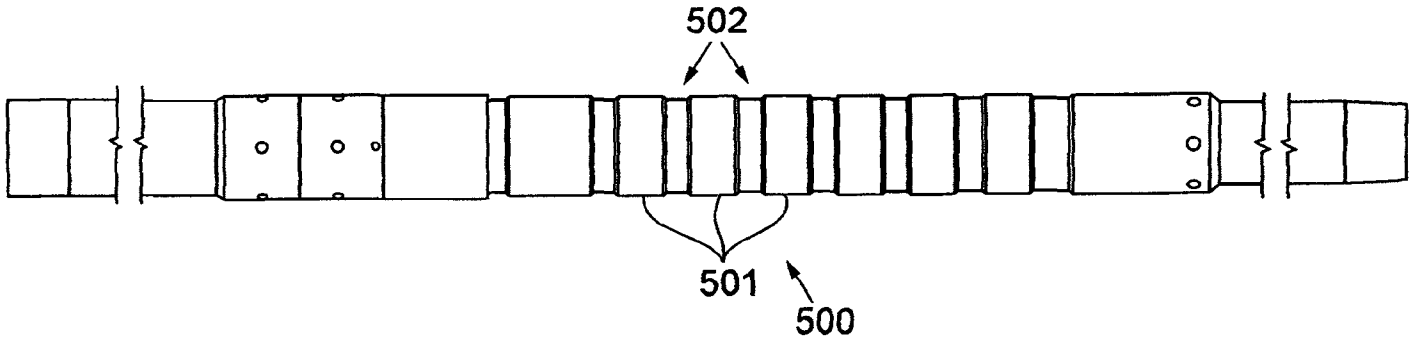
Figure 14:
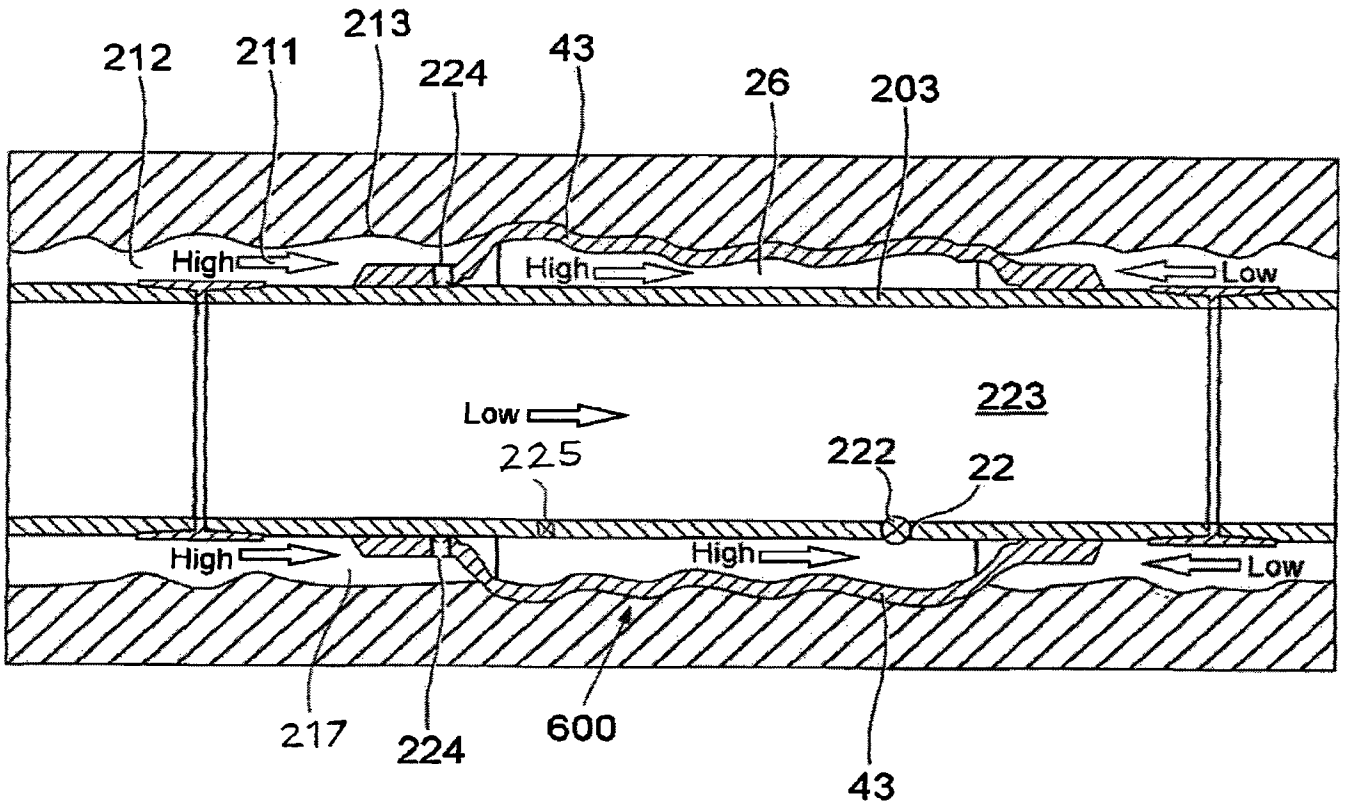

FIG. 6*a* is a cross-sectional view of a perforated liner provided with two sleeve members;

FIG. 6*b* shows the perforated liner in a borehole of FIG. 6*a* with a hydraulic expansion tool inserted therein;

FIG. 6*c* is a cross-sectional view of the perforated liner of FIGS. 6*a* and 6*b* with expanded sleeves;

FIG. 7 shows a cross sectional view of a perforated liner, two sleeve members and the applied frac pressure during a frac operation in accordance with the present invention;

FIG. 8 is a close up view of one of the sleeve members shown in FIG. 7;

FIG. 9 is a schematic view showing a plurality of the elastomer bands bonded to the outside surface of the sleeve of FIG. 7;

FIG. 10 shows embodiments of the sleeves according to the present invention connected by hydraulic control line;

FIG. 11(*a*) shows a further, more preferred, embodiment of a casing section with a surrounding sleeve welded thereto in accordance with the present invention;

FIG. 11(*b*) is a cross-sectional view of the more preferred embodiment of FIG. 11(*a*);

FIG. 11(*c*) is a more detailed view of highlighted section A of FIG. 11(*b*), and in particular shows a weld shroud;

FIG. 11(*d*) is a more detailed cross-sectional schematic view of a portion of the sleeve of FIG. 11(*a*) after elastic and plastic expansion against the inner surface of an open borehole, particularly showing a corrugated effect caused by spaced apart deformable bands provided around the sleeve along its axial length;

FIG. 12 is a yet further, preferred embodiment, of a casing section with a surrounding sleeve welded thereto in accordance with the present invention, where the sleeve has a greater number of elastomer bands than the embodiment of FIG. 11(*a*);

FIG. 13 is a yet further, preferred embodiment of a casing section with a surrounding sleeve welded thereto in accordance with the present invention and is shown as having a fewer number of elastomer bands when compared to the embodiment shown in FIG. 11(*a*); and FIG. 14 is a cross-section and schematic view of a casing section with surrounding sleeve such as that shown in FIG. 13 and having a check valve and a burst disc and being shown with the applied frac pressure during a frac operation in accordance with the present invention.

Figure 1:
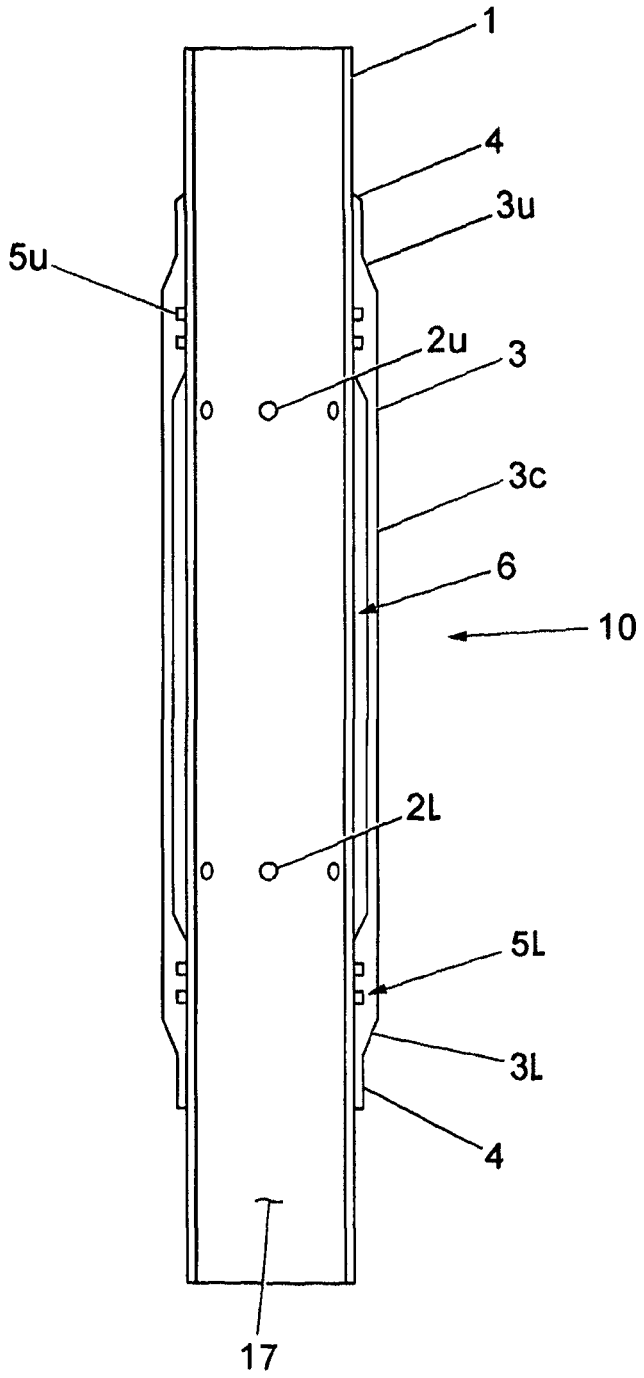
FIG. 1 is a cross-sectional view of a first embodiment of a casing section with surrounding sleeve welded thereto.

FIG. 1 shows an apparatus 10 for use in the methods in accordance with the present invention. A tubing is generally designated at 1 and provided with two sets of circumferential equi-spaced holes through its sidewall; upper ports 2*u* and lower ports 2L. It should be noted that the tubing 1 can be casing, liner or indeed production tubing that is intended to be permanently set or completed in an open borehole.

Hereinafter, the tubing 1 will be referred to as casing 1.

The casing 1, as shown in FIG. 1 could be a standard length of casing manufactured in accordance with API standards. Alternatively the casing 1 shown in FIG. 1 may be replaced by a custom made mandrel. However, it should be noted that casing 1 could be modified by only providing one set of ports (not shown) which could be located at the middle of the length of the casing 1, and furthermore could be modified by only providing one such port (not shown). Casing 1 is located coaxially within sleeve 3. The casing 1 may be either especially manufactured or alternatively is preferably conventional steel casing with ports 2*u*,2L formed therein. The sleeve 3 is typically 316L or Alloy 28 grade steel but could be any other suitable grade of steel or any other metal material or any other suitable material. As shown in FIG. 9, an elastomer 201 or other deformable material is bonded to the outside of the sleeve 3; this may be as a single coating but is preferably a multiple of bands 201 with gaps therebetween. The bands 201 or coating may have a profile or profiles machined into them.

The apparatus 10 comprises a sleeve 3 which is a steel cylinder with tapered upper and lower ends 3*u* and 3L and an outwardly wasted central section 3*c* having a relatively thin sidewall thickness. Sleeve 3 circumferentially surrounds casing 1 and is attached thereto at its upper end 3*u* and lower end 3L, via pressure-tight welded connections 4.

Since the central section of sleeve 3 is wasted outwardly and is stood off from the casing 1, this portion of the sleeve 3 is not in direct contact with the exterior of the casing 1 which it surrounds. The inner surface of the outwardly wasted section 3*c* of sleeve and the exterior of the casing 1 define a chamber 6.

Upper O-ring seals 5*u* are also provided towards the upper end of sleeve 3*u* but interior of the upper welded connection 4. Similarly lower seals 5L are positioned towards the lower end of sleeve 3L but are also positioned interior of the lower welded connections. Seals 5*u* and 5L are in direct contact with the exterior of the casing and the ends of the sleeve, 3*u* and 3L thereby providing a pressure tight connection between the interior of sleeve 3 and the exterior of casing 1 and thus act as a secondary seal or backup to the seal provided by the welded connections 4.

Ports 2*u* and 2L permit fluid communication between the interior or throughbore of casing 1 and chamber 6.

Figure 2:
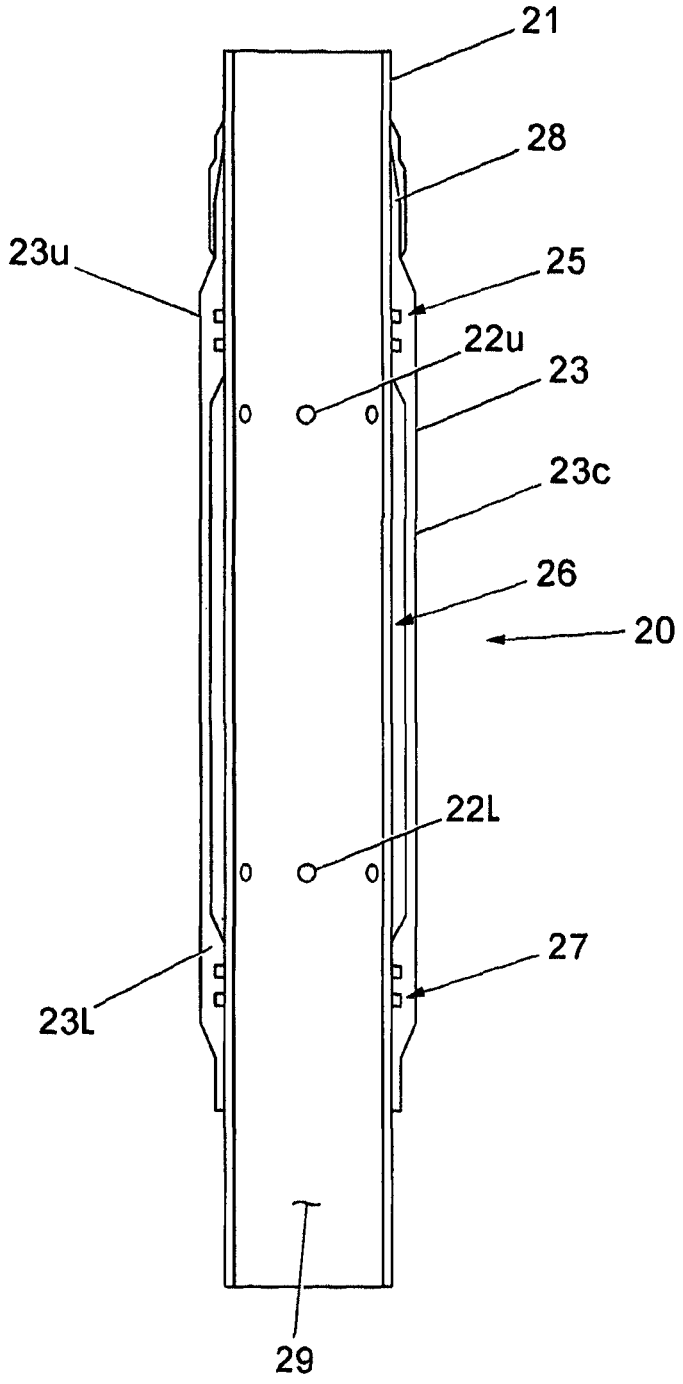
FIG. 2 is a cross-sectional view of a second embodiment of a casing section with an outer sleeve mechanically clamped thereto at one end and a sliding seal provided at the other end.

A second embodiment of an apparatus 20 in accordance with the present invention is shown in FIG. 2 and comprises a sleeve 23 which is substantially cylindrical in shape with upper and lower ends 23*u*, 23L and an outwardly wasted central section and is arranged co-axially around casing 21 which is similar to casing 1 of FIG. 1. Sleeve 23 is secured at its upper end 23*u* to the casing 21 by means of a mechanical clamp 28. Towards the upper end 23*u* of the sleeve, a pair of seal members 25 are also provided in the form of O-rings to provide a pressure tight connection between the upper end of the sleeve 23*u* and the exterior of the casing 21. Sleeve 23 has a lower end 23L which is provided with a pair of sliding O-ring seals 27.

The exterior of the casing 21 in the region of the seals 25, 27 is preferably prepared by machining to improve the surface condition thereby achieving a more reliable connection between the seals 25, 27 and the exterior of the casing 21.

Upper end 23*u* along with seals 25 and lower end of sleeve 23L along with sliding seals 27, wasted central section of sleeve 23*c* and exterior of casing 21 define a chamber 26. Sidewall of casing 21 is provided with circumferential equi-spaced ports 22 through its sidewall which permits fluid communication between the interior of casing 21 and the chamber 26.

Chamber 26 can be filled with pressurised fluid such as hydraulic fluid to cause expansion of the wasted central section of the sleeve member 23*c* in the radially outward direction, which causes simultaneous upwards movement of the sliding seals 27, which has the advantage over the first embodiment of the sleeve 3 that the thickness of the sidewall of the outwardly wasted central section 23*c* is not further thinned by the radially outwards expansion. However any such upwards movement should be restricted such that the ports 22L, 22*u* in the sidewall of casing 21 remain within chamber 26.

Figure 3:
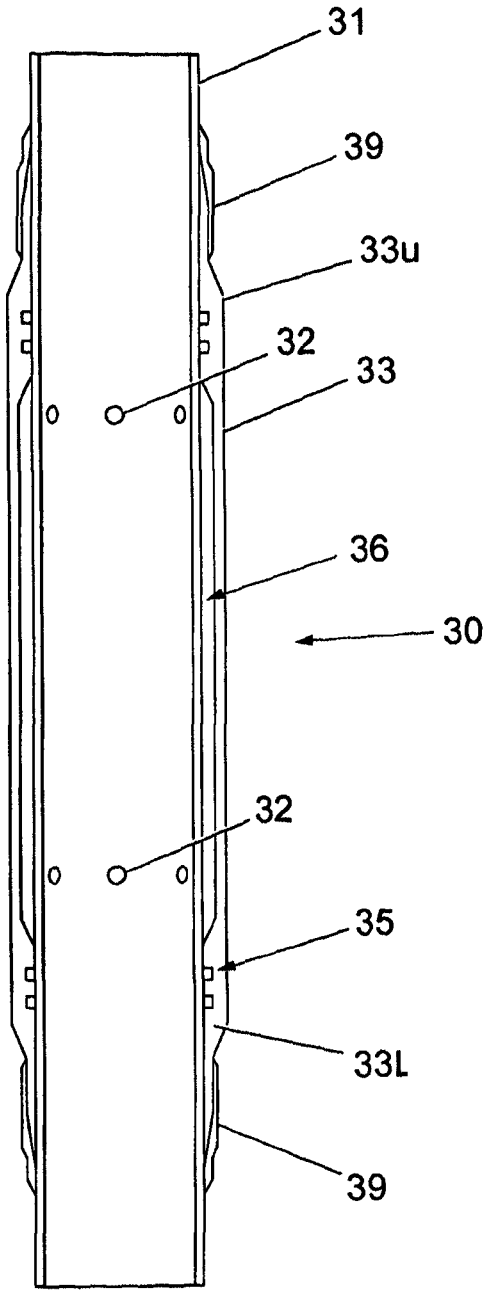
FIG. 3 is a cross-sectional view of a third embodiment of a casing section with an outer sleeve mechanically clamped at both ends.

A further embodiment of apparatus 30 in accordance with the present invention is shown in FIG. 3, where the apparatus 30 is arranged in a similar manner to the apparatus 10, 20 of FIGS. 1 and 2. However, sleeve 33 of FIG. 3 is attached to casing 31 at both the upper end 33*u* and lower end 33L by clamps 39. Clamps 39 are provided to hold the ends of sleeve 33 in position to prevent the sleeve 33 becoming dislodged when the casing 31 is run into the wellbore. Clamp 39 at the upper end 33*u* of the sleeve will allow sleeve 33 to move in a downward direction enabling expansion thereof. However upwards movement of the upper end 33*u* is prevented by clamp 39 which acts as an impediment. Similarly, clamp 39 at the lower sleeve end 33L prevents downward movement, but will permit the lower sleeve end 33L to move upwardly. The clamps 39 also ensure that the sleeve 33 maintains the correct position in relation to the ports 32. Additionally, the clamps 39 maintain the sleeve in position over a section of casing 31 with prepared external surfaces. The surfaces can be prepared by machining and optimise the effectiveness of the two pairs of seals 35.

Isolation barrier apparatus 10, 20, or 30 is conveyed into the borehole by any suitable means, such as incorporating the apparatus into a casing or liner string and running the string into the wellbore until it reaches the location within the open borehole at which operation of the apparatus 10, 20, 30 is intended. This location is normally within the borehole at a position where the sleeve 3, 23, 33 is to be expanded in order to, for example, isolate the section of borehole 180*a* located above the sleeve 3, 23, 33 from that below 180*b* in order to provide zonal isolation in order that a frac'ing or stimulation operation can be performed on the formation 180*b* located in between the two sleeves 43*a*, 43*b* as will be described subsequently.

Figure 4:
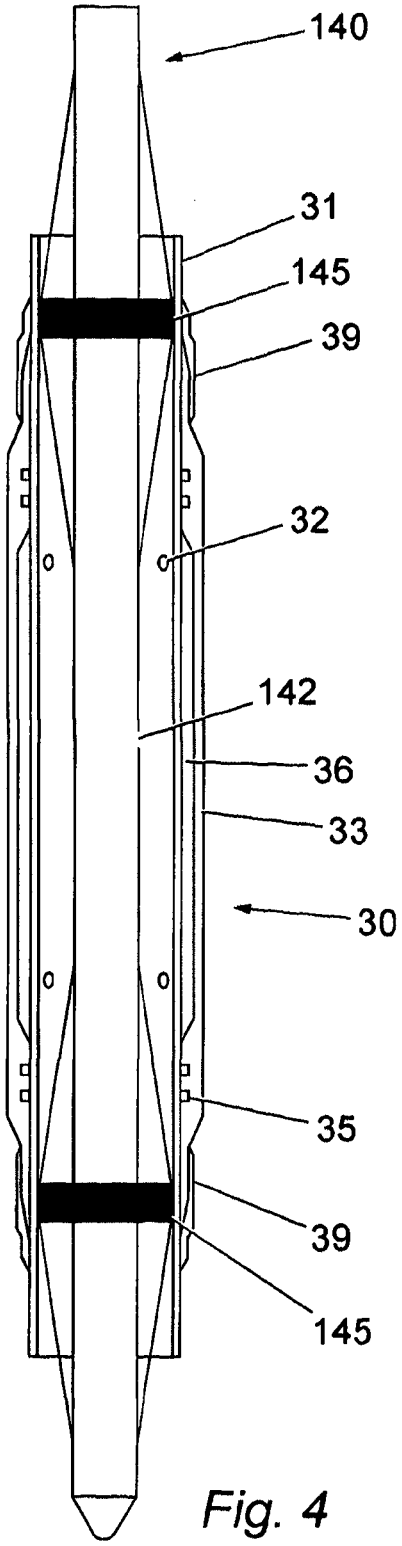
FIG. 4 is a cross-sectional view of the casing section and attached outer sleeve of FIG. 3 and an hydraulic expansion tool therein.

Expansion of the sleeve member 3, 23, 33 can be effected by a hydraulic expansion tool such as that shown in FIG. 4. FIG. 4 shows tool 140 inserted into the casing section 31 shown in FIG. 3. Once the casing 31 reaches its intended location, tool 140 can be run into the casing string from surface by means of a drillpipe string or other suitable method. The tool 140 is provided with upper and lower seal means 145, which are operable to radially expand to seal against the inner surface of the casing section 31 at a pair of spaced apart locations in order to isolate an internal portion of casing 31 located between the seals 145; it should be noted that said isolated portion includes the fluid ports 32. Tool 140 is also provided with an aperture 142 in fluid communication with the interior of the casing 31.

To operate the tool 140, seal means 145 are actuated from the surface (in a situation where drillpipe or coiled tubing is used) to isolate the portion of casing. Fluid, which may be hydraulic fluid, is then pumped under pressure through the coiled tubing or drillpipe such that the pressurised fluid flows through tool aperture 142 and then via ports 32 into chamber 36.

A detailed description of the operation of such an expander tool 140 is described in UK Patent Application No. GB0403082.1 (now published under UK Patent Publication No GB2398312) in relation to the packer tool 112 shown in FIG. 27 with suitable modifications thereto, where the seal means 145 could be provided by suitably modified seal assemblies 214, 215 of GB0403082.1, the disclosure of which is incorporated herein by reference. The entire disclosure of GB0403082.1 is incorporated herein by reference.

Tool 140 would operate in a similar manner when inserted into casing 1, 21 of FIGS. 1 and 2. In the case where wireline is used to convey tool 140 into the borehole, a pump motor is operated to pump fluid from a hydraulic fluid reservoir possibly through a pressure intensifier (depending upon final expansion pressure required) into chambers 6, 26, 36 through aperture 142 via ports 2, 22, 32.

Figure 5:
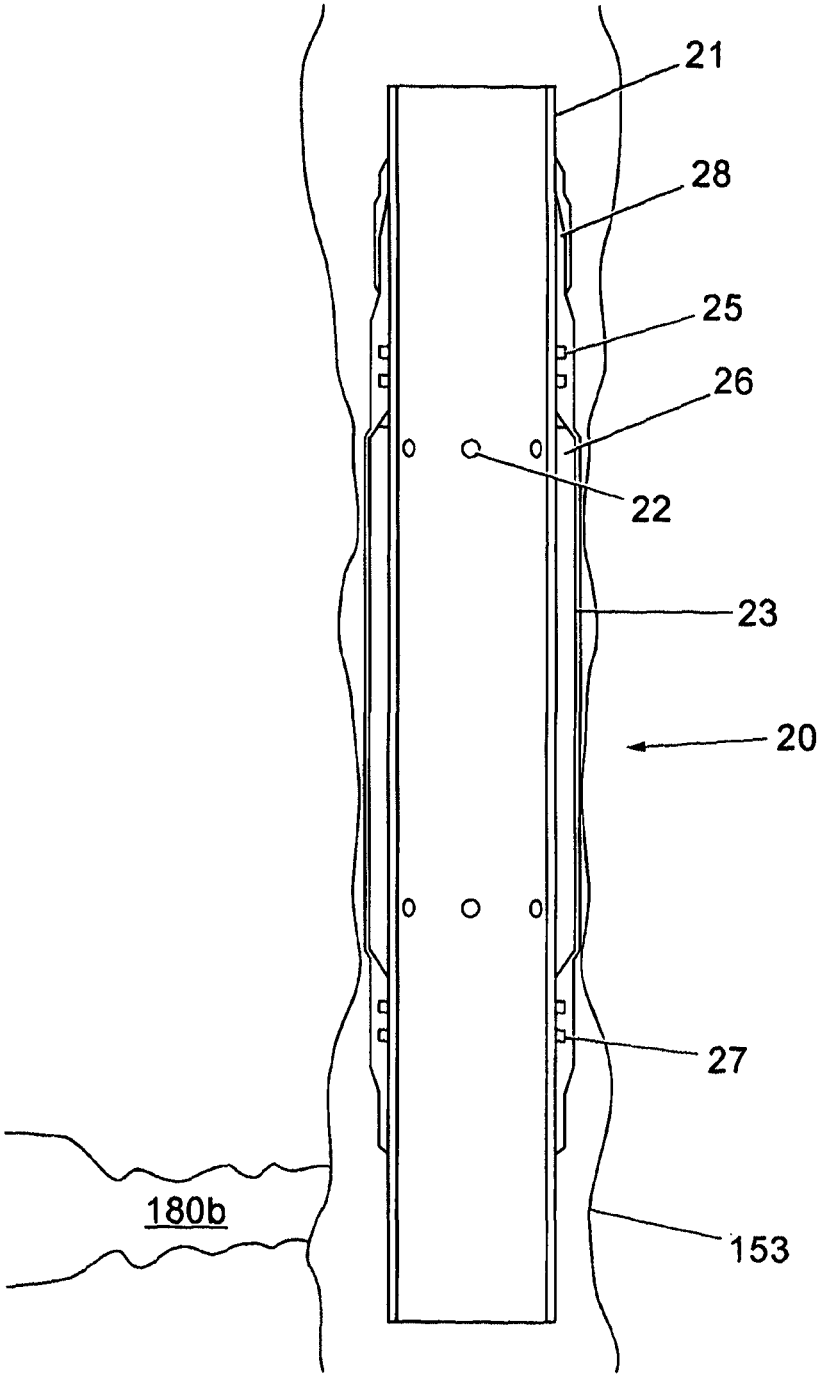
FIG. 5 is a cross-sectional view of the casing section of FIG. 2 and expanded outer sleeve in contact with a borehole wall.

In either scenario, the increase in pressure of hydraulic fluid directly then causes the sleeve 3, 23, 33 to move radially outwardly and seal against a portion of the inner circumference of the borehole 153. The pressure within the chambers 6, 26, 36 continues to increase such that the sleeve 3, 23, 33 initially experience elastic expansion followed by plastic deformation. The sleeve 3, 23, 33 expands radially outwardly beyond its yield point, undergoing plastic deformation until the sleeve 3, 23, 33 bears against the inner surface of the borehole 153 as shown in FIG. 5. If desired, the pressurised fluid within the chambers 6, 26, 36 can be bled off following plastic deformation of the sleeve 3, 23, 33. Accordingly, the sleeve 3, 23, 33 has been plastically expanded by hydraulic fluid pressure and without any mechanical expansion means being required FIG. 5 shows the casing 21 of FIG. 2 with sleeve 23 in its expanded configuration, bearing against the borehole wall 153. Chamber 26 is filled with pressurised fluid which is prevented from exiting the chamber 26 by means of optional check valves (not shown in FIG. 5 but shown in FIG. 14 and described subsequently) attached to ports 22 to maintain the sleeve 23 in an expanded condition; the check valves permit the flow of pressurised fluid from the throughbore 17, 29 into the chamber 6, 26 but prevent the flow of fluid in the reverse direction. If check valves are used, a burst disk (not shown in FIG. 5 but shown in FIGS. 13 and 14 and described subsequently) will preferably also be provided in the side wall of the sleeve 23.

However, instead of using hydraulic fluid, pressurised chemical fluid can be pumped into chamber 26 to expand sleeve 23, as hereinbefore described. Once expanded the sleeve 23 may be maintained in position by check valves or the chemical fluid can be selected such that it sets in place after a certain period of time. Such a chemical fluid could be cement but it should be noted that such chemical fluids need not be employed because the sleeve 23 will retain its expanded shape once the expansion fluid pressure is removed.

Alternatively, the ports 22 may be provided with a burst disk (not shown) therein, which will prevent fluid flow through the ports 22 until an operator intentionally ruptures the disks by applying hydraulic fluid pressure from the throughbore 17, 29 to the inner face of the disk until the pressure is greater than the rated strength of the disk.

FIG. 6 shows a sequence for expanding two sleeve members. Different formations are indicated by reference numerals 180 *a-e*.

FIG. 6*a* shows the embodiment where a perforated liner/casing 171 is attached at its upper end by any suitable means such as a liner hanger to the lower end of a cemented casing 160. Liner 171 is provided with two sleeves 173*u*, 173L sealed thereto and similar to those previously described. The liner 171 is perforated at location 171*p*, where perforation location 171*p* is chosen such that it is substantially aligned with formation 180*b* that requires to be frac'd.

FIG. 6*b* shows the perforated liner 171 of FIG. 6*a* in a borehole 163 with a hydraulic expansion tool 190 inserted therein.

Activation of the hydraulic expansion tool 190 increases the pressure in the chambers defined by the sleeves 173 such that the sleeves expand outwardly as shown in FIG. 6*c*. Thus, the sleeves 173*u*, 173L isolate formation 180*b* (which may be a hydrocarbon producing zone which requires to be frac'd) from the zones above and below 180*a*, 180*c* to 180*e* (which may be, for example water producing zones) and thus provide a means of achieving zonal isolation.

FIG. 7 shows a cross sectional view of a perforated liner 205 and two sleeves 43*a*, 43*b* which have been expanded by the hydraulic expansion tool 140 or 190. As can been seen in FIG. 7, the liner 203 comprises a perforated liner section 205 located in between the pair of sleeves 43*a*, 43*b* and the perforated liner section 205 is shown as being aligned with a section of the formation 180*b* that requires to be frac'd.

FIG. 7 shows the borehole after the hydraulic expansion tool 140 or 190 has been withdrawn from the well and the inner bore of the liner string 203 has been closed at some point vertically below the lower most sleeve member 43*b* by any conventional means such as for instance dropping a ball (not shown) from the surface such that it lands on a seat (not shown) that is located in the throughbore of the liner 203 at the location to be closed (i.e. below the perforations) or more preferably setting a plug (not shown) below the perforations. Then, frac fluid can be pumped down the liner string 203 either all the way from the surface or through a frac fluid supply conduit 208 that is run into the liner string 203 and into the vicinity of the perforated liner section 205.

The supply of frac fluid in this way means that frac fluid pressure 204 is applied to the inside of the sleeves 43*a*, 43*b* in the direction of arrows 207, perforated liner 205 in the direction of arrows 209 and to the outside of one side of each sleeve 43*a*, 43*b* in the direction of arrows 211*a*, 211*b*.

The frac pressure is applied during a frac operation which will now be described in terms of the following method:—

1. The borehole is drilled in a conventional manner;
2. The completion is run where the completion typically consists of an upper section of large diameter casing string which has a lower section of slightly smaller diameter liner string or section where the casing and/or liner strings/sections have apparatus in accordance with the present invention incorporating sleeves 43 as hereinbefore described installed thereon to provide for a zonal isolation as will be described subsequently;
3. If pre-perforated liner 205 is included in the completion then a hydraulic expansion tool 140 or 190 as hereinbefore described is run into the liner section bore 203 to activate and therefore expand the sleeves 43*a*, 43*b* to provide zonal isolation. However, if the liner 203 is to be perforated subsequently or if sliding sleeves are included in the liner 203 that can be opened subsequently; then all of the sleeves 43 included in the liner string 203 can be expanded at the same time by pressuring up the interior of the liner string 203 from surface (i.e. without the need for tool 140 or 190) and this provides the advantage that less intervention and/or fewer trips into the borehole is/are required;
4. Fluid communication from the interior of the liner string 203 to the zone of the reservoir 180*b* to be frac'd is opened—this may be achieved by either perforating the liner string 203 (assuming it was not pre-perforated) by using conventional perforation techniques (such as perforating guns (not shown) etc.) or by opening sliding sleeves (not shown) that were included in the liner string 203 to expose ports formed through the side wall of the liner 203;
5. A tool 208 is run to supply frac fluid to the frac zone—this step may be optional though, because in some completions, the frac fluid could be pumped all the way from surface through the bore of the casing/liner string to the frac zone;
6. Frac fluid is pumped from surface to the frac zone, either through the tool 208 or in the absence of such a tool as contemplated in step S above, through the bore of the casing/liner string to the frac zone;

7. If present, the sliding sleeves are closed in the region of the frac zone; and
8. Steps 3. to 7. are repeated with the next and subsequent frac zones.

Embodiments hereinbefore (and also those subsequently) described have the great advantage when used in conjunction with a frac operation in that the application of the frac fluid at pressure not only acts on the frac zone 180*b* of the reservoir but also acts on the interior of the sleeves 43 (in the chamber of the sleeves 43) and therefore increases the effectiveness of the pressure seal provided by the sleeves 43 and therefore helps to prevent unwanted fluid from passing between the inner surface of the borehole 213 and the outer surface of the sleeves 43 due to the enhanced seal created therebetween thereby achieving zonal isolation.

FIG. 8 is a close up view of one of the sleeves 43 shown in FIG. 7; the sleeve 43 has already been expanded and is therefore in contact with the borehole 213 and shows the sleeve 43 operating as a barrier to the frac pressure travelling further along the annulus 212 of the borehole 213 in the direction of arrow 211. The performance of the isolation is improved by the frac pressure also acting on the inside of the sleeve 43 in the direction of arrow 207 thereby pushing it into closer contact with the borehole 213.

FIG. 9 is an embodiment of the invention whereby elastomer bands 201 are bonded to the outside surface of the sleeve 43. The elastomer bands 201 are annular ring shaped and are spaced apart along the longitudinal axis of the sleeve 43 such that when the sleeve 43 is expanded, the bands 201 will contact the inside surface of the outer structure or borehole 213 first and therefore the portion 43*b* of the sleeve 43 immediately behind the band 201 will tend to be prevented from any further expansion. The rest of the sleeve 43 (i.e. the portions 43*g*) will continue to expand outwards in the region 43*g* of the gaps/spaces 202 between the bands 201 causing a corrugated effect 216 on the sleeve 43. These corrugations 216 have the great advantage that they increase the stiffness of the sleeve 43 and increase its resistance to collapse forces, as will be described subsequently in greater detail in relation to FIGS. 11 to 13 and particularly as shown in FIG. 11(*d*).

FIG. 10 shows two of the sleeves 43*a*, 43*b* connected with a hydraulic control line 220. The hydraulic control line 220 is terminated at each sleeve 43*a*, 43*b* and at a port 222 in the liner 203 some point higher up in the well; indeed, this control line 220 may extend all the way to surface.

FIG. 11*a* shows a preferred embodiment of an apparatus 300 in accordance with the present invention and which comprises a number of spaced apart elastomeric bands 201 which comprise a width W and which are spaced apart from each by gaps 202 which consist of distance S, where the elastomeric bands 201 also comprise a radial height H. The elastomeric bands 201 are preferably arranged substantially equi-spaced along the length of the outer surface of the sleeve 43 in between the two ends 303U and 303L. As can be seen in FIG. 11*a*, the width W of the bands 201 is preferably greater than the gap distance S. The ends 303U, 303L are preferably arranged to be as wide in diameter as possible and more preferably the outer diameter of each of the concentric annular elastomeric rings 201 also have an outer diameter as great as possible but no greater than the outer diameter of the ends 303U, 303L such that the elastomeric rings 201 will to some extent be protected when running into the hole 213. As shown in FIG. 11*c*, each of the ends 303U, 303L comprises an end nut 305 which is secured to the casing 41 by suitable means such as being locked thereto, etc. There is then provided a seal section housing 307 which is screwed fast to the end nut 305 and which surrounds a suitable arrangement of seals 309 which in use will prevent any fluid from exiting the chamber 26 created when the sleeve 43 is expanded. The inner most ends of the respective seal section housings 307 are secured to the respective ends of the sleeve 43 by welding 308. Advantageously, a weld shroud 310 is provided co-axially about the outer surface of the welding 308 and the respective end of the sleeve 43 and the inner most end of the sealed section housing 307, where the weld shroud 310 is secured to the inner most end of the sealed section housing 307 via suitable screw threaded connection 311 but alternatively could be secured via welding (not shown). Accordingly, a portion of the inner surface or throughbore of the weld shroud 310 is in contact with and therefore lies over the outer surface of the weld 308 and thereby protects the weld 308. More importantly though, the weld shroud 310 is formed from a very strong metal relative to the strength of the metal that forms the sleeve 43 and this provides the advantage that, when the sleeve 43 is expanded by for instance the expander tool 140 or 190, the weld shroud 310 prevents the outer ends of the sleeve 43 and therefore the weld 308 from expanding, at least to a certain extent, such that there is a much lower risk of the weld 308 expanding when compared to the sleeve 43 and therefore the weld 308 is protected by the weld shroud 310. Alternatively, the weld shroud 310 could be made from the same material as the sleeve 43 and the weld shroud 310 protects the weld 308 simply by the thickness of material of the weld shroud 310.

FIG. 12 shows a further embodiment of apparatus 400 in accordance with the present invention, where the apparatus 400 is arranged in a similar manner to the apparatus 300 of FIG. 11A. However, the sleeve 43 of the apparatus 400 is provided with many more elastomeric bands 401 than the apparatus 300. Furthermore, there are some elastomeric bands 403 that are more narrow than the rest of the elastomeric bands 401 including a narrower elastomeric band 403*c* positioned at the very centre point of the apparatus 400 and such narrower bands 403 have the advantage that they provide relatively higher contact pressure and therefore better seating capabilities, as will be discussed in more detail subsequently.

FIG. 13 shows a further embodiment of apparatus 500, where the apparatus 500 is arranged in a similar manner to the apparatus 300 of FIG. 11*a* and 400 of FIG. 12. However, a notable difference with the apparatus 500 compared to the apparatus 300 or 400 is that the apparatus 500 comprises a much fewer number of elastomeric bands 501.

Accordingly, as can be seen in FIGS. 11*a*, 12 and 13, different apparatus 300, 400 and 500 can be chosen by the operator depending on the type of formation 180*b* that is to be isolated from the rest of the formation 180*a*, 180*c*. Importantly however, the elastomeric bands 201, 401 and 501 are applied to the outer surface of the constant outer diameter sleeve 43 such that the elastomeric bands 201, 401 and 501 stand proud of the gaps 202, 402, 502. Furthermore, the elastomeric bands 201, 401, 501 are bonded directly to the expandable sleeve 43 and are preferably formed from HNBR (hydrogenated nitrile rubber) with a suitable hardness such as in the region of 75 although other materials and hardnesses may be suitable depending on the application and the formation 180. The outer surface of the elastomeric bands 201, 401, 501 may be smooth but it may be possible to provide detail machined onto the outer surface (such as a roughness) as this may provide additional sealing qualities.

Furthermore, the distance S of spacing 202, 402, 502 can be configured to allow or permit the maximum expansion

43*g* of the sleeve 43 between each band 201, 401, 501 into the inner surface of the borehole 213, such that a corrugation effect 216 such as that shown in FIG. 11(*d*) will be experienced by the metal material of the sleeve 43. This corrugation effect 216 provides an improvement to the collapse resistance of the sleeve 43 and increases the effectiveness of each elastomeric band 201, 401, 501 as a seal in that the bending of the steel of the sleeve 43 at location 43*g* will tend to pinch the edge 201*e* of each elastomeric band 201, 401, 501, thus causing a higher contact pressure between the elastomeric band 201, 401, 501 and the inner surface of the borehole 213 and the outer surface 43*b* of the sleeve 43 with which it is in contact with. It should also be noted that the width W of each elastomeric band 201, 401, 501 is important to its sealing capabilities in that shorter or narrower elastomeric bands 201, 401, 501 tend to provide higher contact pressure, although the optimum width W depends on whether the sealing capability, the axial load capacity or a combination of both are important.

FIG. 14 shows a further alternative but preferred embodiment of apparatus 600 in accordance with the present invention and which is very similar to the apparatus 500 shown in FIG. 13 (although the elastomeric bands 501 are not shown in FIG. 14). However, the apparatus 600 has the further features of having a one way fluid flow check valve 222 provided through the side wall of the casing 203 within port 22. The check valve 222 is arranged such that it permits fluid flow from the throughbore 223 of the casing 203 into the chamber 26 and prevents fluid from passing in the reverse direction from the chamber 26 into the throughbore 223. Accordingly, when the sleeve 43 is expanded by pumping highly pressurised fluid into the chamber 26, that fluid will remain in the chamber 26, even if the fluid pressure in the throughbore 223 is bled off.

If a check valve 222 is provided within the port 22, then at least one burst disk 224 is also provided in a port formed all the way through the side wall of the sleeve 43 or through the sidewall of the seal carrier 307, but is importantly only provided at the end of the sleeve 43 that will be closest to the perforated section of the casing 203 and therefore, will be closest to the end of the sleeve 43 that will see the high pressure of the frac fluid when it is pumped. The burst disk 224 will be arranged to burst and therefore let fluid within the chamber 26 to flow into the annulus 212 in the location of the formation 180*b* to be frac'd in order to protect the rest of the sleeve 43, in situations where there is a pre-determined pressure differential across it. In other words, the burst disk 224 can be intentionally sacrificed in order to protect the rest of the sleeve 43 when a certain pressure differential is experienced-say 5,000 psi. Alternatively, and more importantly the burst disk 224 can be intentionally burst to allow the high pressure fluid from the high pressure zone of the annulus 212 into chamber 26 to reinforce the sleeve 26. The apparatus 600 shown in FIG. 14 will likely be used in situations where the zonal isolation barrier apparatus 600 must have a substantially higher performance in collapse than the other embodiments. In operation, the apparatus 600 will be inflated by for instance an expansion tool 140 or 190 as hereinbefore described such that fluid is pumped through the check valve 222 to inflate the sleeve 43. However, when the final expansion fluid pressure is achieved (say 10,000 psi) the rupture disk 224 is arranged to burst such that fluid can then communicated between the high pressure zone 217 of the annulus 212 and the chamber 26. After the disk 224 has burst, this therefore means that there is zero differential pressure across the sleeve 43 between the high pressure zone 217 and the chamber 26 and therefore allows the zonal isolation barrier 600 to maintain zonal isolation whatever the pressure differential between the zones 180*a*, 180*b*, 180*c* to be isolated. It is important however that the zonal isolation barrier 600 is deployed in the correct orientation with the rupture disk 224 arranged on the high pressure side. Therefore, the check valve 222 will then be the final barrier between the high pressure zone 217 and the throughbore 223 of the casing 203. It also means that the apparatus 600 will require to be inflated individually by the inflating apparatus 140, 190.

Optionally, instead of the burst disk 224, or preferably additionally thereto, a pressure relief valve 225 can also be provided within another port 22 formed through the sidewall of the casing or liner 203 where the pressure relief valve allows fluid to pass from the chamber 26 back into the throughbore 17, 29, 223 of the liner 203 if it exceeds a predetermined pressure differential. This could be particularly important in situations where it is anticipated that the pressure in the chamber 26 may increase significantly such as due to a temperature increase in the fluid trapped therein when production of the well is started. If such a pressure relief valve were not provided then there may be a possibility that the tubing 203 or the sleeve 43 could collapse or burst due to such a pressure increase. Accordingly, the presence of such a pressure relief valve will permit some of the trapped and over pressurised fluid to escape the chamber 26 back into the throughbore 223.

Optionally, another port 22 may also be provided with a burst disk (not shown) therein, which will prevent fluid flow through the ports 22 from the throughbore 17, 29, 223 into the chamber 6, 26, 36 until an operator intentionally ruptures said burst disk by applying hydraulic fluid pressure in the throughbore 17, 29, 223 which acts on the inner face of said burst disk until the pressure is greater than the rated strength of the disk. The provision of such a burst disk in another port 22 provides the advantage that the operator can choose when to allow hydraulic fluid into the chamber 6, 26, 36 and therefore when to begin expansion of the sleeve 3, 23, 33, 43.

Modifications and improvements may be made to the embodiments hereinbefore described without departing from the scope of the invention. Furthermore, selected features from one or more of the embodiments herein described can be combined with other features of other embodiments hereinbefore described as desired to provide additional embodiments.

For example, the frac fluid hereinbefore described could be conventional frac fluid (i.e. incorporating relatively small rigid spheres which act to keep the fractures in the reservoir from reclosing after the frac fluid pressure is removed) or could be e.g. acid, steam, CO2 or any other suitable gas or liquid used in a stimulation or injection or reinjection operation.

We claim:

1. A method of performing zonal isolation during a frac operation with a casing/liner string that has been pre-perforated, the casing/liner string formed from a plurality of casing/liner joints, the method comprising the steps of:— a) drilling the borehole, b) running in a casing/liner string which is to be permanently installed in an open hole section of said borehole, wherein at least one zonal isolation device is provided on or associated with the casing/liner string, the zonal isolation device comprising a deformable metal sleeve member defining a chamber into which pressurised fluid can be inserted, through an aperture in the casing/liner string that is surrounded by the metal sleeve member, to permanently expand the metal sleeve member outwards towards the open hole borehole, by plastic deformation of said metal sleeve member;

c) running a tool into a throughbore of the casing/liner string into a vicinity of a pre-perforated liner of the casing/liner string and operating the tool to introduce fluid under pressure into the throughbore of a section of the casing/liner string to expand and thereby activate the zonal isolation device(s) such that the at least one zonal isolation device provides a seal against the inner surface of the open borehole, and repeat step c) for any other required zonal isolation device(s) and once step c) is completed, withdrawing the tool of step c) from the casing/liner string;

d) closing the throughbore of the casing/liner string at some point vertically below a lower most zonal isolation device;

e) supplying frac fluid down said throughbore of the casing/line string and through perforations in the casing/liner string to a zone requiring to be frac'd in order to perform the frac operation; and f) repeating steps c), d) and e) as required for each additional zone to be frac'd;

whereby pressure of the frac fluid supplied in step e) acts not only on an outside of the at least one zonal isolation device as said frac fluid acts on said zone being frac'd, but also on an interior of the at least one zonal isolation device, directly from the throughbore of the casing/liner string via the aperture, to enhance the seal provided by the sleeve member against the inner surface of the open borehole and to prevent collapse of said sleeve member by said pressure of said frac fluid acting on said outside of the at least one zonal isolation device.

2. A method of performing zonal isolation during a frac operation with a casing/liner string that has not been pre-perforated, the casing/liner string formed from a plurality of casing/liner joints, the method comprising the steps of:— a) drilling an open hole borehole from a surface into a formation comprising zones, b) running in a casing/liner string which is to be permanently installed in an open hole section of the open hole borehole, wherein at least one zonal isolation device is provided on or associated with the casing/liner string, the zonal isolation device comprising a deformable metal sleeve member defining a chamber into which pressurised fluid can be inserted, through an aperture in the casing/liner string that is surrounded by the metal sleeve member, to permanently expand the metal sleeve member outwards towards the open hole borehole, by plastic deformation of said metal sleeve member;

c) closing a throughbore of the casing/liner string at some point vertically below a lower most zonal isolation device;

d) pressuring up the throughbore of the casing/liner string from the surface to activate and thereby expand the zonal isolation device(s) by means of pressurised fluid flowing from the throughbore and through the aperture in the casing/liner string that is surrounded by the sleeve member of the respective zonal isolation device;

e) opening at least one fluid communication channel in the casing/liner string to a frac zone, the at least one fluid communication channel located vertically above a lower most zonal isolation device;

f) supplying frac fluid into the throughbore of the casing/liner string;

g) permitting the frac fluid to flow from the throughbore, through the at least one communication channel and into the zone to be frac'd in order to perform the frac operation;

h) repeating steps e) through g) as required for each additional zone to be frac'd, whereby pressure of the frac fluid acts not only on an outside of the at least one zonal isolation device as said frac fluid acts on said zone being frac'd, but also on an interior of the at least one zonal isolation device, directly from the throughbore of the casing/liner string via the aperture, to enhance the seal provided by the sleeve member against the inner surface of the open borehole and to prevent collapse of said sleeve member by pressure of said frac fluid acting on said outside of the at least one zonal isolation device.

3. The method according to claim 2, wherein step e) is performed by perforating the casing/liner string.

4. The method according to claim 2, wherein step e) is performed by opening a sliding sleeve to expose ports in the casing/liner string and step h) includes closing the sliding sleeve as required.

5. The method according to claim 1, wherein high pressure fluid is pumped into the well and targeted at a particular zone.

6. The method according to claim 1, wherein the joints of the casing/liner string are fabricated with male threads at each end, and are joined together via couplings with female threads.

7. The method according to claim 1, wherein the joints of the casing/liner string are fabricated with male threads on one end and female threads on the other.

8. The method according to claim 1, wherein the joints of the casing/liner string are manufactured from plain carbon steel, stainless steel, aluminum, titanium, or fiberglass.

9. The method according to claim 2, wherein step g) is performed by pumping frac fluid at a pressure higher than the pressure required to fracture the formation in the zone to be frac'd.

10. The method according to claim 2, wherein the joints of the casing/liner string the are fabricated with male threads at each end, and are joined together via couplings with female threads.

11. The method according to claim 2, wherein the joints of the casing/liner string are fabricated with male threads on one end and female threads on the other.

12. The method according to claim 2, wherein the joints of the casing/liner string are manufactured from plain carbon steel, stainless steel, aluminum, titanium, or fiberglass.

13. A method of performing zonal isolation during a frac operation with a casing/liner string that has been pre-perforated, the casing/liner string formed from a plurality of casing/liner joints, the method comprising the steps of:— a) drilling the borehole, b) running in a casing/liner string which is installed in an open hole section of said borehole, wherein at least one zonal isolation device is provided on or associated with the casing/liner string, the zonal isolation device comprising a deformable metal sleeve member defining a chamber into which pressurised fluid can be inserted, through an aperture in the casing/liner string that is surrounded by the metal sleeve member, to permanently expand the metal sleeve member outwards towards the open hole borehole, by plastic deformation of said metal sleeve member;

c) running a tool into a throughbore of the casing/liner string into a vicinity of a pre-perforated liner of the casing/liner string and operating the tool to introduce fluid under pressure into the throughbore of a section of the casing/liner string to expand and thereby activate the zonal isolation device(s) such that the at least one zonal isolation device provides a seal against the inner surface of the open borehole;

d) withdrawing the tool from the borehole and then supplying frac fluid to a zone requiring to be frac'd in order to perform the frac operation; and e) repeating steps c) and d) as required for each additional zone to be frac'd, whereby pressure of the frac fluid acts not only on an outside of the at least one zonal isolation device as said frac fluid acts on said zone being frac'd but also on an interior of the at least one zonal isolation device to enhance the seal provided by the sleeve member against the inner surface of the open borehole and to prevent collapse of said metal sleeve member by said pressure of said frac fluid acting on said outside of the at least one zonal isolation device.

14. A method of performing zonal isolation during a frac operation with a casing/liner string that has not been pre-perforated, the casing/liner string formed from a plurality of casing/liner joints, the method comprising the steps of:— a) drilling the borehole, b) running in a casing/liner string which is installed in an open hole section of said borehole, wherein at least one zonal isolation device is provided on or associated with the casing/liner string, the zonal isolation device comprising a deformable metal sleeve member defining a chamber into which pressurised fluid can be inserted to expand the metal sleeve member outwards towards the open hole borehole, by plastic deformation of said metal sleeve member;

c) running a tool into a throughbore of the casing/liner string and pressuring up the throughbore of a section of the casing/liner string to activate and thereby expand the zonal isolation device(s), and then withdrawing the tool;

d) after withdrawing the tool, opening at least one fluid communication channel in the casing/liner string to a frac zone by perforating the casing/liner string;

e) supplying frac fluid into the throughbore of the casing/liner string;

f) permitting the frac fluid to flow from the throughbore, through the at least one communication channel and into the zone requiring to be frac'd in order to perform the frac operation; and g) repeating steps d) through f) as required for each additional zone to be frac'd, whereby pressure of the frac fluid acts not only on an outside of the at least one zonal isolation device as said frac fluid acts on said zone being frac'd, but also on an interior of the at least one zonal isolation device to enhance the seal provided by the sleeve member against the inner surface of the open borehole and to prevent collapse of said sleeve member by said pressure of said frac fluid acting on said outside of the at least one zonal isolation device.

15. A method of performing zonal isolation during a frac operation with a casing/liner string that has not been pre-perforated, the casing/liner string formed from a plurality of casing/liner joints, the method comprising the steps of:— a) drilling the borehole, b) running in a casing/liner string which is installed in an open hole borehole, wherein at least one zonal isolation device is provided on or associated with the casing/liner string, the zonal isolation device comprising a deformable metal sleeve member defining a chamber into which pressurised fluid can be inserted to permanently expand the metal sleeve member outwards towards the open hole borehole, by plastic deformation of said metal sleeve member;

c) running a tool into a throughbore of the casing/liner string and pressuring up the throughbore of a section of the casing/liner string to activate and thereby expand the zonal isolation device(s), and then withdrawing the tool;

d) after withdrawing the tool, open at least one fluid communication channel in the casing/liner string to a frac zone by opening a sliding sleeve to expose ports in the casing/liner string;

e) supplying frac fluid into the throughbore of the casing/liner string;

f) permitting the frac fluid to flow from the throughbore, through the at least one communication channel and into the zone requiring to be frac'd in order to perform the frac operation;

g) closing the sliding sleeve; and h) repeating steps d) to g) as required for each additional zone to be frac'd, whereby pressure of the frac fluid acts not only on an outside of the at least one zonal isolation device as said frac fluid acts on said zone being frac'd but also on an interior of the at least one zonal isolation device to enhance the seal provided by the metal sleeve member against the inner surface of the open borehole and to prevent collapse of said metal sleeve member by said pressure of said frac fluid acting on said outside of the at least one zonal isolation device.

* * * * *